US007175213B1

(12) United States Patent
Blangiardo

(10) Patent No.: US 7,175,213 B1
(45) Date of Patent: Feb. 13, 2007

(54) HANDLE ROTATION RESTRAINT AND METHOD

(76) Inventor: Robert Blangiardo, 845 King Richards Ct., Deerfield, IL (US) 60015

( * ) Notice: Subject to any disclaimer, the term of this patent is extended or adjusted under 35 U.S.C. 154(b) by 0 days.

(21) Appl. No.: 11/246,833

(22) Filed: Oct. 11, 2005

(51) Int. Cl.
*E05C 19/18* (2006.01)

(52) U.S. Cl. ..... 292/288; 292/1; 292/DIG. 2; 292/24

(58) Field of Classification Search ..... 292/288, 292/DIG. 2, 24, 289, 253, DIG. 16, 1, DIG. 65; 70/416, 429–430, 211, 199, 202
See application file for complete search history.

(56) References Cited

U.S. PATENT DOCUMENTS 848,644 A * 4/1907 Flegel ..... 292/288
2,939,308 A 6/1960 Trammell, Jr.
3,500,668 A 3/1970 Henry
3,536,287 A * 10/1970 Kramer ..... 248/301
D272,986 S 3/1984 DeStefano
4,798,069 A 1/1989 DeForrest, Sr.
5,303,965 A 4/1994 Meehan
5,517,838 A * 5/1996 Moore ..... 70/416
6,182,485 B1 * 2/2001 Moore ..... 70/416
2004/0183315 A1 * 9/2004 O'Donohoe ..... 292/288

* cited by examiner

*Primary Examiner*—Brian E. Glessner

(57) ABSTRACT

A handle rotation restraint and method includes a tether that has an upper end and a lower end. A coupler is attached to the upper end of the tether. The coupler is adapted for removably attaching the upper end to an upper edge of a door having a handle coupled thereto. The coupler is attached to the upper edge of the door. A primary loop is attached to the lower end. A lever grip of the handle is extended through the primary loop so that an end of the lever grip is prevented from is rotated down.

13 Claims, 5 Drawing Sheets

HANDLE ROTATION RESTRAINT AND METHOD

BACKGROUND OF THE INVENTION

1. Field of the Invention

The present invention relates to handle lock devices and more particularly pertains to a new handle lock device for preventing the rotation of a lever grip handle.

2. Description of the Prior Art

The use of handle lock devices is known in the prior art. U.S. Pat. No. 5,303,965 describes a plate that is attachable to a door and which has a slot therein for receiving an end of a handle. The slot permits only partial rotational movement of the handle. Another type of handle lock device is U.S. Pat. No. 4,798,069 which includes a housing that is positionable on a lever handle for restricting access to the lock of the lever handle. A similar device is found in U.S. Pat. No. 6,182,485 and includes a strap that is extendable between a deadbolt actuator and a handle to prevent unlocking of the deadbolt.

While these devices fulfill their respective, particular objectives and requirements, the need remains for a device that is adapted for preventing rotation of a lever grip of a handle. Such prevention of rotation will enable a parent to restrict access to a toddler who would otherwise be able to place their weight on the handle and open the handle.

SUMMARY OF THE INVENTION

The present invention meets the needs presented above by generally comprising a tether that has an upper end and a lower end. A coupler is attached to the upper end of the tether. The coupler is adapted for removably attaching the upper end to an upper edge of a door having a handle coupled thereto. The coupler is attached to the upper edge of the door. A primary loop is attached to the lower end. A lever grip of the handle is extended through the primary loop so that an end of the lever grip is prevented from is rotated down.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
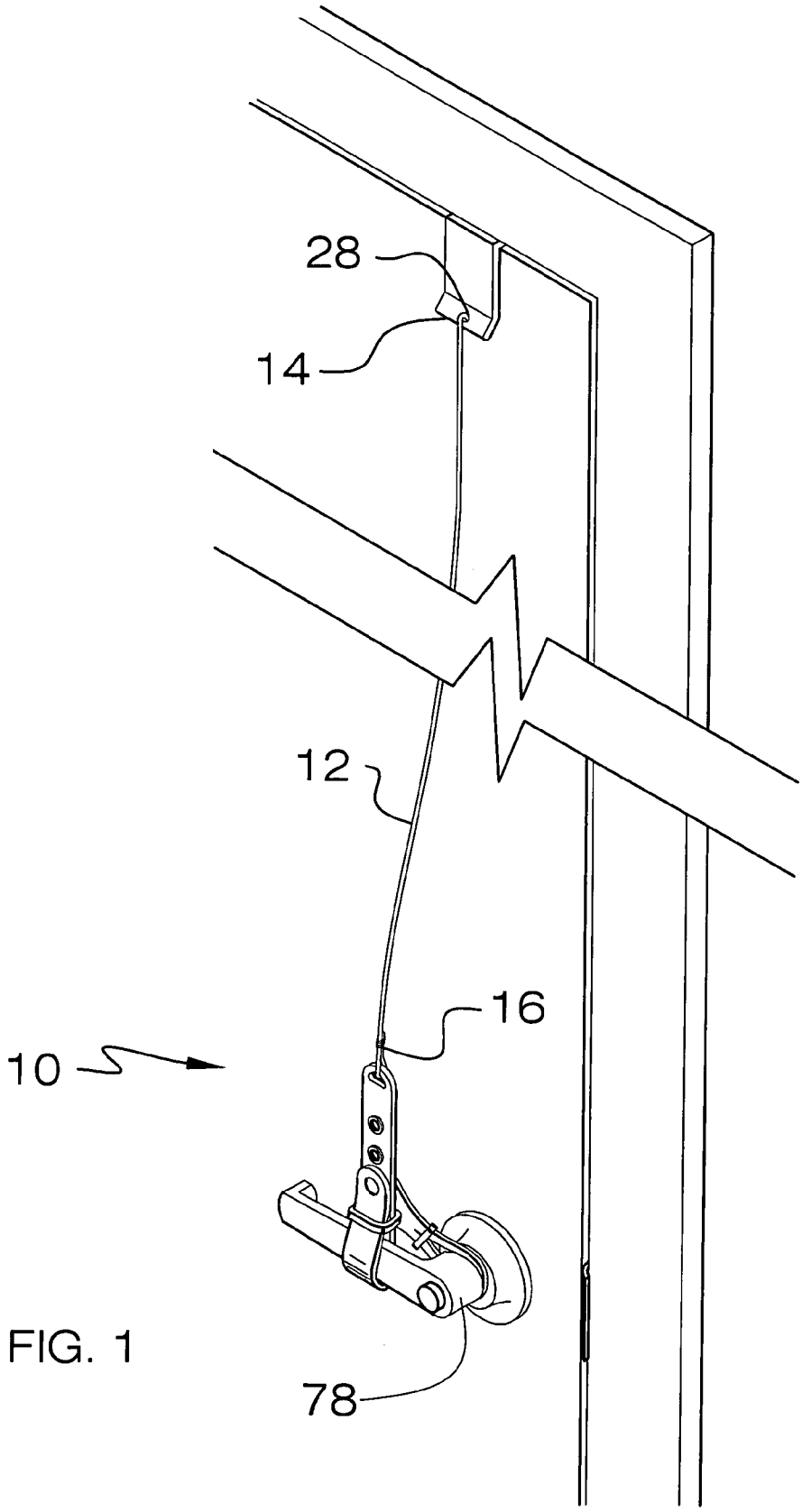
FIG. 1 is a perspective in-use view of a handle rotation restraint and method according to the present invention.
Figure 2:
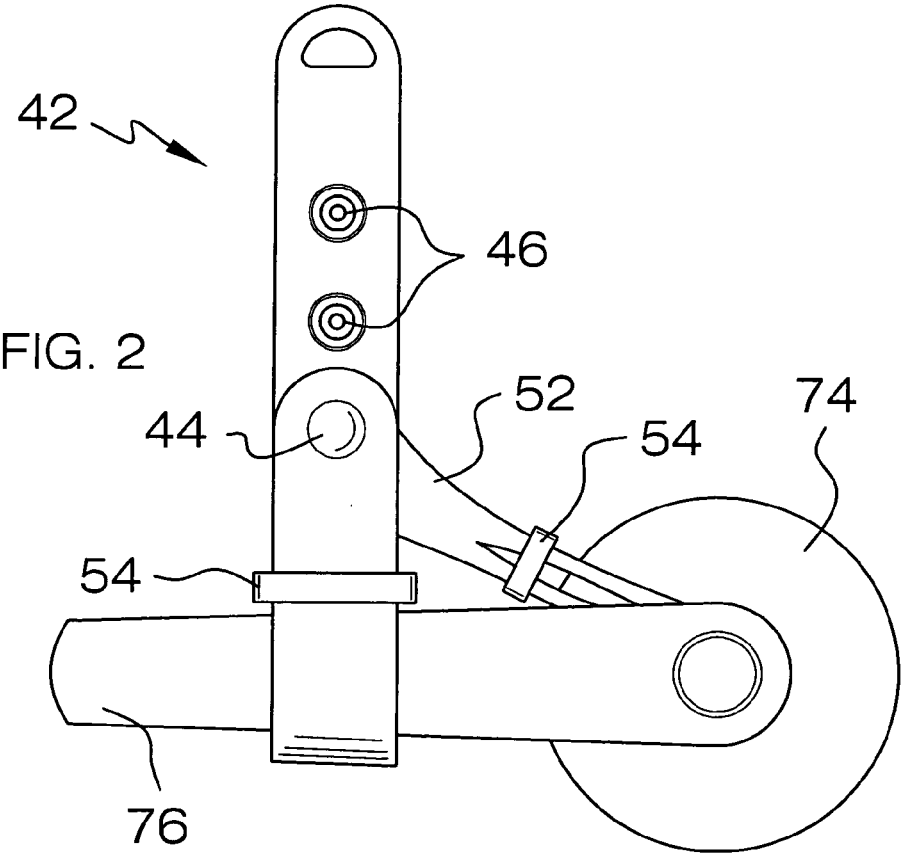
FIG. 2 is a front view of the present invention.
Figure 3:
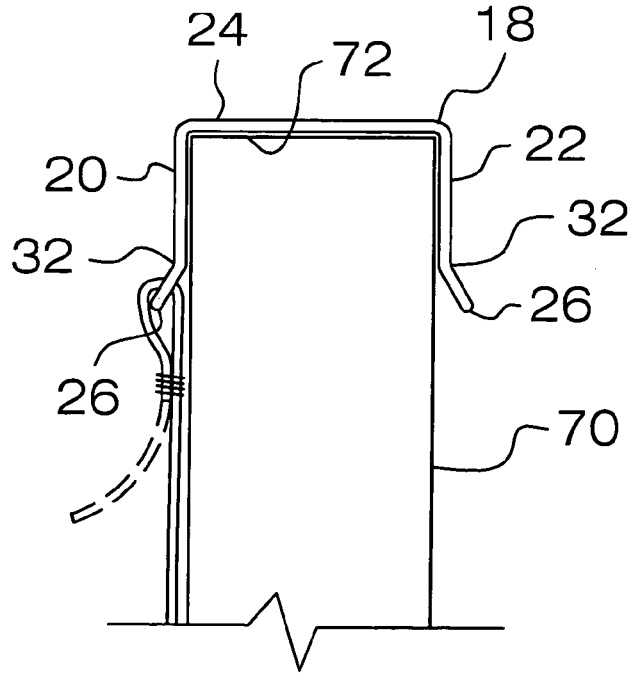
FIG. 3 is a side view of a coupler of the present invention.

With reference now to the drawings, and in particular to FIGS. 1 through 5 thereof, a new handle lock device embodying the principles and concepts of the present invention and generally designated by the reference numeral 10 will be described.

As best illustrated in FIGS. 1 through 5, the handle rotation restraint and method 10 is particularly well suited for preventing the rotation of a handle 74 having a lever grip 76. The restraint and method 10 generally comprises a flexible tether 12 has an upper end 14 and a lower end 16. The tether 12 may be made of conventional materials such as nylon or cotton.

Figure 4:
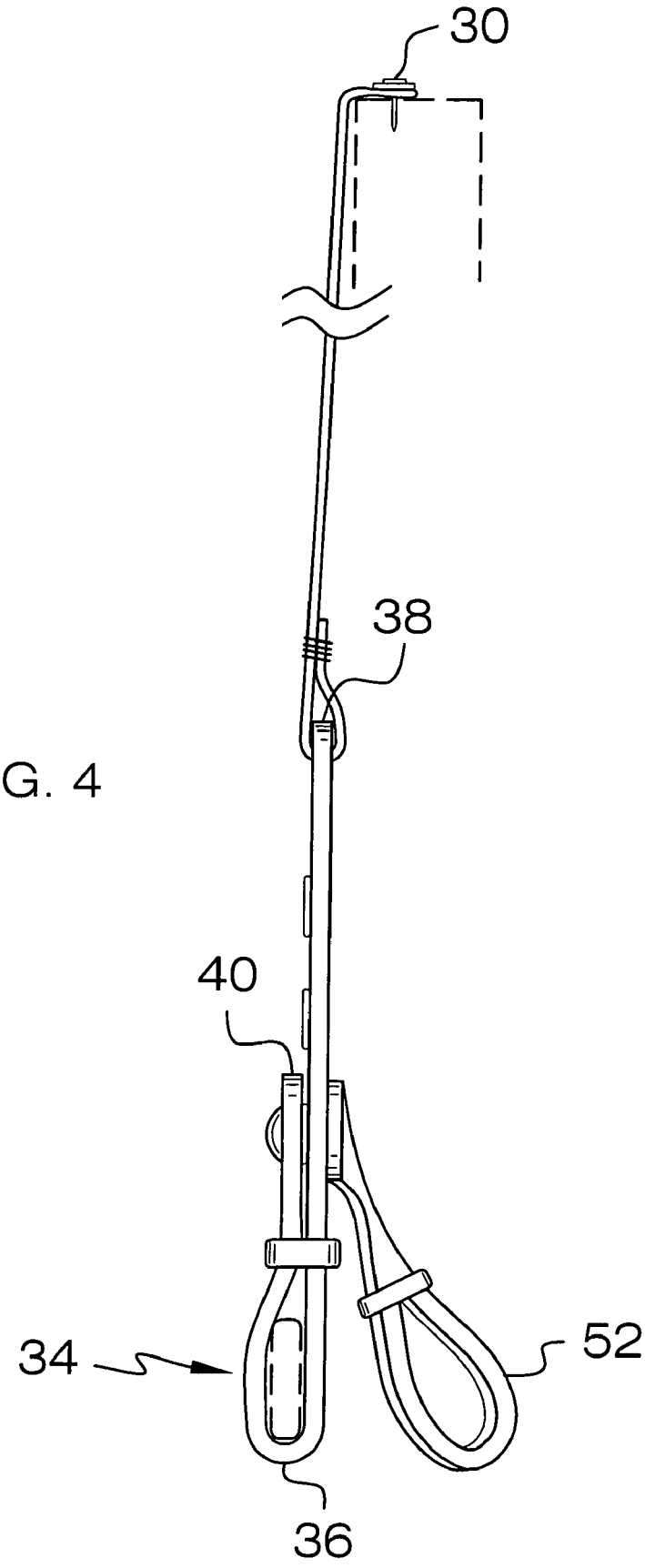
FIG. 4 is a side view of a second embodiment of the coupler of the present invention.

A coupler 18 attached to the upper end 14 of the tether 12 is adapted for removably attaching the upper end 14 to an upper edge 72 of a door 70 having the handle 74 coupled thereto. The coupler 18 includes a bracket that has a first leg 20, a second leg 22 and central portion 24 extending between the first 20 and second 22 legs so that each of the first 20 and second 22 legs extends in a generally same direction away from the central portion 24. Each of the first 20 and second 24 legs has a free end 26. The first leg 20 has an aperture 28 therein positioned adjacent to the free end 26. The upper end 14 of the tether 12 is looped through the aperture 28 so that the tether 12 is attached to the coupler 18 and so that a user of the coupler 18 may selectively determine a length of the tether 12 with respect to the coupler 18. Each of the first 20 and second 22 legs has a bend 32 therein so that the free ends 26 are angled outwardly with respect to each other. The coupler 18 is attached to the upper edge 72 of the door 70 so that the central portion 24 abuts the upper edge 72 and each of the first 20 and second 22 legs extends downwardly on opposite sides of the door 70. By flaring the free ends 26 outwardly, the risk of scratching the door 70 is reduced. Alternatively, as shown in FIG. 4, the coupler 18 may include a securing member 30, such as a tack, that may be used for securing the upper end 14 of the tether 12 to the top edge 72 of the door 70.

Figure 5:
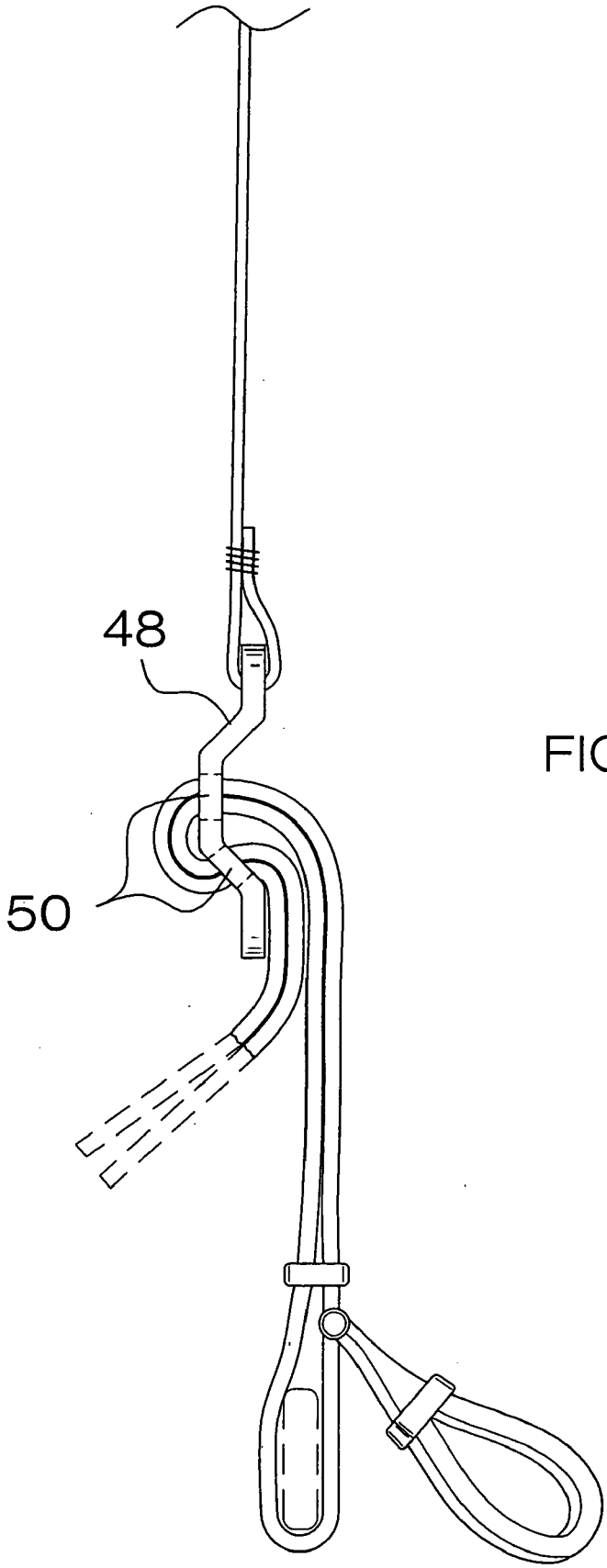
FIG. 5 is a side view of a second embodiment of a fastener of the present invention.

A primary loop 34 is attached to the lower end 16. The primary loop 34 has a selectively adjustable length, and preferably an adjustable circumference. The primary loop 34 includes an elongated flexible member 36 that has a first end 38 and a second end 40. The first end 38 is attached to the lower end 16 of the tether 12. A fastener 42 releasably attaches the second end 40 to a selective position on the flexible member 36 so that a loop is defined. The fastener 42 includes a snap means which comprises a first mating portion 44 attached to the flexible member 36 adjacent to the second end 40 and a plurality of second mating portions 46 attached to the elongated member 36. The first mating portion 44 is selectively snapped together with one of the second mating portions 46. The second mating portions 46 are spaced from each other and are aligned along a longitudinal axis of the elongated member 36. The second mating portions 36 are positioned nearer to the first end 38 than the second end 40. The primary loop 34 is comprised of a resiliently elastic material. The fastener 42 may include hook and loop fastening means may be used instead of the snap means. FIG. 5 shows an alternate embodiment, which includes a fastener that attaches primary loop 34 to the tether 12 and allows the length of the primary loop 34 to be adjusted. The alternate embodiment includes a panel 48 having a pair of openings 50 therein through which the first 38 and second 40 ends are extended.

A secondary loop 52 is attached to the primary loop 34. The secondary loop 52 is positioned generally between the first end 38 and the second end 40 of the elongated member 36. The secondary loop 52 is also comprised of a resiliently elastic material. The secondary loop 52 may be attached to the primary loop 34 with a pivot member.

Figure 6:
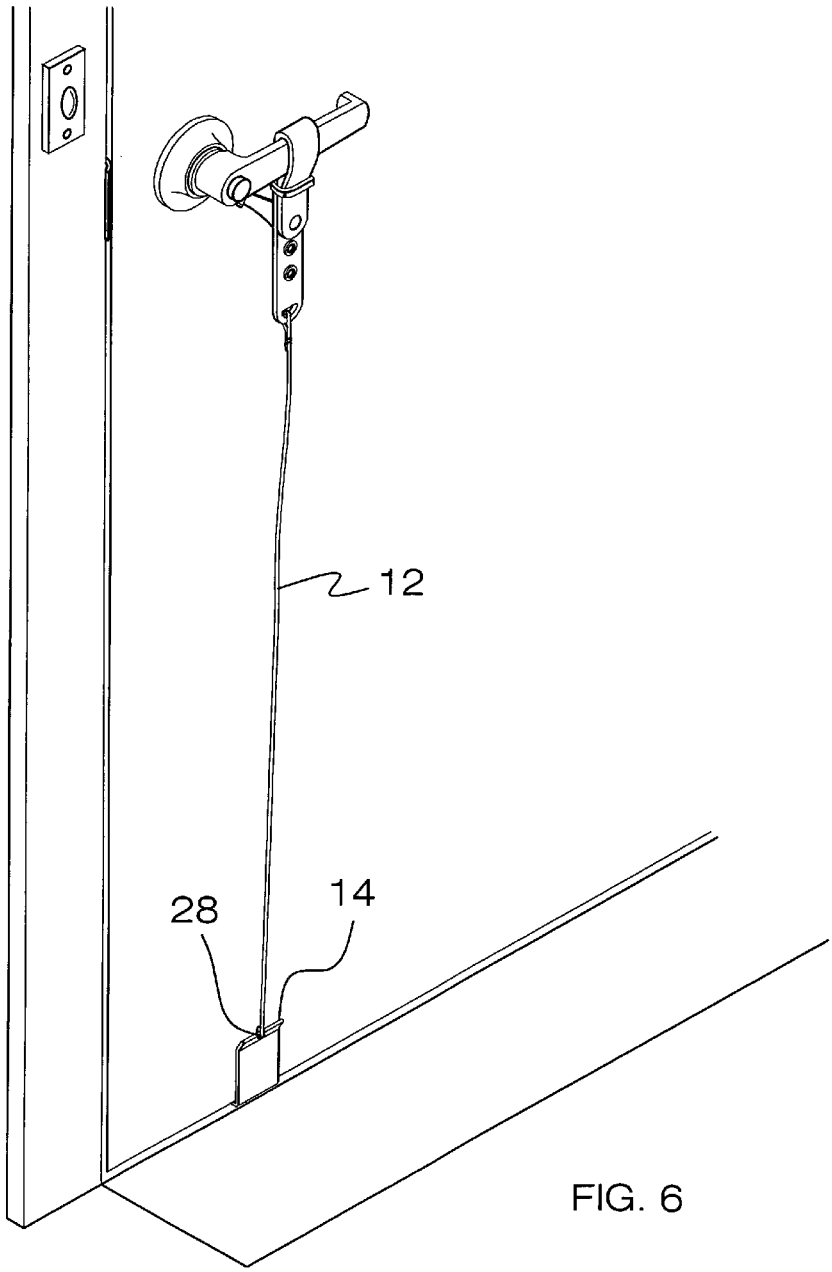
FIG. 6 is a perspective view of a second method of using the present invention.

In use, the handle 74 is extended through the secondary loop 52 so that the secondary loop 52 extends around a base 78 of the handle 74. The secondary loop 52, while not necessary, retains the primary loop 34 adjacent to the handle 74 for ease of use. The lever grip 76 of the handle 74 is extended through the primary loop 34 so that an end of the lever grip 76 is prevented from is rotated downward. The primary loop 34 or the tether 12 may be adjusted to ensure that the tether 12 is taut when the primary loop 34 engages the lever grip 76. Bands 54 are positioned on the primary 34 and secondary 52 loops, which can be moved to tighten the primary 34 and secondary 52 loops as needed. FIG. 6 shows an alternate use wherein the handle 74 is prevented from being moved upwardly.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of preventing the rotation of a handle including a lever grip, said method comprising the steps of:

providing a tether having an upper end and a lower end;

providing a coupler being attached to said upper end of said tether, said coupler being adapted for removably attaching said upper end to an upper edge of a door having said handle coupled thereto;

attaching said coupler to the upper edge of the door;

providing a primary loop being attached to said lower end; and extending the lever grip of the handle through the primary loop such that an end of said grip is prevented from being rotated down and providing a secondary loop being attached to said primary loop; and extending said handle through said secondary loop such that said secondary loop extends around a base of the handle.

2. The method according to claim 1, wherein said coupler includes a bracket having a first leg, a second leg and central portion extending between said first and second legs such that each of said first and second legs extends in a generally same direction away from said central portion, each of said first and second legs having a free end, said first leg having an aperture therein positioned adjacent to said free end, said upper end of said tether being looped through said aperture such that said tether is attached to said coupler, wherein said central portion abuts the upper edge and each of said first and second legs extends downwardly on opposite sides of the door when said coupler is attached to the door.

3. The method according to claim 2, wherein each of said first and second legs having a bend therein such that said free ends are angled outwardly with respect to each other.

4. The method according to claim 1, wherein said primary loop has a selectively adjustable length.

5. The method according to claim 4, wherein said primary loop includes an elongated flexible member having a first end and a second end, said first end being attached to said lower end of said tether, a fastener releasably attaching said second end to a selective position on said flexible member such that a loop is defined.

6. The method according to claim 5, wherein said fastener includes snap means including a first mating portion attached to said flexible member adjacent to said second end and a plurality of second mating portions attached to said elongated member, said first mating portion being selectively snapped together with one of said second mating portions.

7. The method according to claim 6, wherein said second mating portions are spaced from each other and are aligned along a longitudinal axis of said elongated member.

8. The method according to claim 6, wherein said second mating portions are positioned nearer to said first end than said second end.

9. The method according to claim 5, wherein said primary loop is comprised of a resiliently elastic material.

10. The method according to claim 5, further including the steps of:

providing a secondary loop being attached to said primary loop, said secondary loop being positioned generally between said first end and said second end of said elongated member; and extending said handle through said secondary loop such that said secondary loop extends around a base of the handle.

11. The method according to claim 10, wherein said secondary loop is comprised of a resiliently elastic material.

12. The method according to claim 1, wherein said secondary loop is comprised of a resiliently elastic material.

13. A method of preventing the rotation of a handle including a lever grip, said method comprising the steps of:

providing a tether having an upper end and a lower end;

providing a coupler being attached to said upper end of said tether, said coupler being adapted for removably attaching said upper end to an upper edge of a door having said handle coupled thereto, said coupler including a bracket having a first leg, a second leg and central portion extending between said first and second legs such that each of said first and second legs extends in a generally same direction away from said central portion, each of said first and second legs having a free end, said first leg having an aperture therein positioned adjacent to said free end, said upper end of said tether being looped through said aperture such that said tether is attached to said coupler, each of said first and second legs having a bend therein such that said free ends are angled outwardly with respect to each other;

attaching said coupler to the upper edge of the door such that said central portion abuts the upper edge and each of said first and second legs extends downwardly on opposite sides of the door;

providing a primary loop being attached to said lower end, said primary loop having a selectively adjustable length, said primary loop including an elongated flexible member having a first end and a second end, said first end being attached to said lower end of said tether, a fastener releasably attaching said second end to a selective position on said flexible member such that a loop is defined, said fastener including snap means including a first mating portion attached to said flexible member adjacent to said second end and a plurality of second mating portions attached to said elongated member, said first mating portion being selectively snapped together with one of said second mating portions, said second mating portions being spaced from each other and being aligned along a longitudinal axis of said elongated member, said second mating portions being positioned nearer to said first end than said second end, said primary loop being comprised of a resiliently elastic material;

providing a secondary loop being attached to said primary loop, said secondary loop being positioned generally between said first end and said second end of said elongated member, said secondary loop being comprised of a resiliently elastic material;

extending said handle through said secondary loop such that said secondary loop extends around a base of the handle; and extending said lever grip of the handle through the primary loop such that an end of said lever grip is prevented from being rotated down.

* * * * *